US010365615B2

(12) United States Patent
Liu et al.

(10) Patent No.: US 10,365,615 B2
(45) Date of Patent: Jul. 30, 2019

(54) WEARABLE APPARATUS

(71) Applicant: BOE TECHNOLOGY GROUP CO., LTD., Beijing (CN)

(72) Inventors: Kairan Liu, Beijing (CN); Wenbo Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 245 days.

(21) Appl. No.: 15/328,246

(22) PCT Filed: Jul. 12, 2016

(86) PCT No.: PCT/CN2016/089800
§ 371 (c)(1),
(2) Date: Jan. 23, 2017

(87) PCT Pub. No.: WO2017/063408
PCT Pub. Date: Apr. 20, 2017

(65) Prior Publication Data

US 2017/0261941 A1 Sep. 14, 2017

(30) Foreign Application Priority Data

Oct. 15, 2015 (CN) ..... 2015 1 0670909

(51) Int. Cl.
*G04G 17/04* (2006.01)
*G04G 9/00* (2006.01)
(Continued)

(52) U.S. Cl.
CPC ..... *G04G 17/045* (2013.01); *G04C 3/001* (2013.01); *G04G 9/0005* (2013.01); *G04G 9/10* (2013.01)

(58) Field of Classification Search
CPC ..... G04G 9/0005; G04G 17/045
See application file for complete search history.

(56) References Cited

U.S. PATENT DOCUMENTS 5,128,662 A * 7/1992 Failla ..... G06F 1/1601 248/924
7,618,260 B2 11/2009 Daniel et al.
(Continued)

FOREIGN PATENT DOCUMENTS

CN 1336631 A 2/2002
CN 1347233 A 5/2002
(Continued)

OTHER PUBLICATIONS

International Search Report of PCT/CN2016/089800 in Chinese, dated Aug. 29, 2016 with English translation.
(Continued)

*Primary Examiner* — Edwin A. Leon
*Assistant Examiner* — Jason M Collins
(74) *Attorney, Agent, or Firm* — Collard & Roe, P.C.

(57) ABSTRACT

A wearable apparatus, including: a mounting component, configured to hold a relationship between relative positions of the wearable apparatus and its user; a folding panel mounted on the mounting component, the folding panel including at least two display screens interconnected at a joint where sensors are disposed; and a controller signal connected with individual display screens and the sensors respectively, the controller being configured to control corresponding display screens to turn on or turn off based on the state of the folding panel detected by the sensors. The state of the folding panel in the wearable apparatus can be adjusted according to the needs of a user and thereby the usage needs of the user can be satisfied.

18 Claims, 6 Drawing Sheets

(51) Int. Cl.
*G04G 9/10* (2006.01)
*G04C 3/00* (2006.01)

(56) References Cited

U.S. PATENT DOCUMENTS

| | | | | |
|---|---|---|---|---|
| 8,014,635 | B2 * | 9/2011 | Kondo | G06F 1/1616 382/312 |
| 8,860,632 | B2 | 10/2014 | Kilpatrick, II et al. | |
| 2005/0107142 | A1 | 5/2005 | Soejima | |
| 2009/0326833 | A1 | 12/2009 | Ryhanen et al. | |
| 2010/0182265 | A1 | 7/2010 | Kim et al. | |
| 2012/0182227 | A1 | 7/2012 | Wu et al. | |
| 2013/0250738 | A1 * | 9/2013 | Kim | G04G 17/08 368/29 |
| 2013/0271392 | A1 * | 10/2013 | Lyons | G04G 17/083 345/173 |
| 2016/0242516 | A1 * | 8/2016 | Lepore | A44C 5/2071 |
| 2017/0077211 | A1 * | 3/2017 | Yamazaki | H01L 51/0097 |
| 2018/0129249 | A1 * | 5/2018 | Ko | H02S 30/00 |

FOREIGN PATENT DOCUMENTS

| | | | |
|---|---|---|---|
| CN | 1617549 | A | 5/2005 |
| CN | 2770247 | Y | 4/2006 |
| CN | 201229478 | Y | 4/2009 |
| CN | 101788850 | A | 7/2010 |
| CN | 201535860 | U | 7/2010 |
| CN | 201897749 | U | 7/2011 |
| CN | 102150094 | A | 8/2011 |
| CN | 202283066 | U | 6/2012 |
| CN | 202443378 | U | 9/2012 |
| CN | 102705642 | A | 10/2012 |
| CN | 102710823 | A | 10/2012 |
| CN | 202694014 | U | 1/2013 |
| CN | 103149831 | A | 6/2013 |
| CN | 103220401 | A | 7/2013 |
| CN | 204241854 | U | 4/2015 |
| CN | 104796504 | A | 7/2015 |
| CN | 204462662 | U | 7/2015 |
| CN | 104869192 | A | 8/2015 |
| CN | 105137743 | A | 12/2015 |
| CN | 205038451 | U | 2/2016 |

OTHER PUBLICATIONS

Notice of Transmittal of the International Search Report of PCT/CN2016/089800 in Chinese, dated Aug. 29, 2016.

Written Opinion of the International Searching Authority of PCT/CN2016/089800 in Chinese, dated Aug. 29, 2016 with English translation.

Chinese Office Action in Chinese Application No. 201510670909.2, dated Jan. 23, 2017 with English translation.

Second Chinese Office Action in Chinese Application No. 201510670909.2, dated Sep. 22, 2017 with English translation.

* cited by examiner

WEARABLE APPARATUS

CROSS REFERENCE TO RELATED APPLICATIONS

This application is the National Stage of PCT/CN2016/089800 filed on Jul. 12, 2016, which claims priority under 35 U.S.C. § 119 of Chinese Application No. 201510670909.2 filed on Oct. 15, 2015, the disclosure of which is incorporated by reference.

TECHNICAL FIELD

Embodiments of the present invention relate to a wearable apparatus.

BACKGROUND

Intelligent watches have not only the functions of watches but also many other functions such as support for answer of telephone calls, photo browsing, reception and transmission of emails, short messages etc. and the like, so that they have been widely used in recent years.

However, due to the restriction by the way in which intelligent watches are worn, it is impossible for the display screen of an intelligent watch to be produced with a relatively large size, and as a result the amount of contents that can be displayed in the display area of the intelligent watch is relatively small. For example, when a user is browsing web pages using an intelligent watch, he has to turn page continually to continue web page browsing for the relatively small amount of contents displayed in the display area of the intelligent watch, causing great inconvenience to user reading. For another example, during reply to an email or a short message by a user using an intelligent watch, since the display screen of an intelligent watch has a relatively small size and thus its touch area for touch operation is also relatively small, when touch operation is performing on such a relatively small touch area, such problems as inaccuracy of touch, insensitivity of response or the like are liable to occur, leading to great inconvenience to the use by the user.

SUMMARY

According to at least one embodiment, a wearable apparatus is provided, comprising: a mounting component configured to hold a relationship between relative positions of the wearable apparatus and its user; a folding panel mounted on the mounting component, the folding panel including at least two display screens interconnected at a joint where sensors are disposed; and a controller signal connected with individual display screens and the sensors respectively, the controller being configured to control corresponding display screens to turn on or turn off based on the state of the folding panel detected by the sensors.

For example, wherein the wearable component is an intelligent watch and the mounting component is the watchband of the intelligent watch.

For example, wherein the at least two display screens of the folding panel are rotatably interconnected.

For example, wherein one of the display screens of the folding panel may rotate with respect to another one an angle less than or equal to 180°.

For example, wherein the two display screens have their respective sensors disposed on the rotatable joint therebetween.

For example, wherein the at least two display screens include a first display screen, a second display screen and a third display screen; the first display screen and the second display screen are rotatably interconnected and the second display screen and the third display screen are rotatably interconnected as well.

For example, wherein, when the folding panel is in the folded state, the third display screen and the second display screen are stacked on top of each other, the third display screen is covered on the second display screen, and the second display screen and the first display screen are stacked on top of each other as well.

For example, wherein the folding panel includes five display screens; a first one of them is a rectangular display screen while others four are all display screens with circular arc edges; the four display screens are respectively connected to four edges of the first display screen in a rotatable way.

For example, wherein the four display screens are covered on the first display screen when the folding panel is in the folded state.

For example, wherein the four display screens and the first display screen form a circular display area when the folding panel is in the unfolded state.

For example, wherein the watchband is an annular one-piece watchband.

For example, wherein a first buckle is disposed on the watchband and a first clamping groove is disposed on the back side of the folding panel to engage with the first buckle.

For example, wherein the first buckle is a buckle bar extending along the axial direction of the watchband.

For example, wherein the cross-section of the buckle bar is T-shaped, and the first clamping groove is correspondingly a T groove.

For example, wherein the display screens may have a rectangular, triangle, trapezoid, circle, semi-circle.

For example, wherein, when the display screens are rectangular shaped, one of a pair of opposite side edges of a display screen has balls disposed thereon while the other of the pair of side edges has ball mounting holes disposed therein to mate with the balls, or one of a pair of opposite side edges of the display screen has a pivot shaft disposed thereon while the other of the pair of side edge has a shaft hole disposed therein to mate with the pivot shaft.

For example, wherein one of the other pair of opposite side edges of the display screen has a second buckle disposed thereon while the other of the pair of side edges has a clamping groove disposed therein to mate with the second buckle.

For example, wherein, when the folding panel is in the folded state, the uppermost display screen is the top screen which is a single-sided display screen or a double-sided display screen.

For example, wherein the folding panel in the unfolded state has a rectangular, triangle, trapezoid, circle or semi-circle shape.

For example, wherein the controller is a chip, which is integrated in at least one of the display screens.

BRIEF DESCRIPTION OF DRAWINGS

The accompanying figures described here are provided to facilitate further comprehension and form part of the present disclosure. Illustrative embodiments of the present disclosure and the description thereof are used to explain the present disclosure without imposing any improper limitation thereto. In the drawings.

Figure 1:
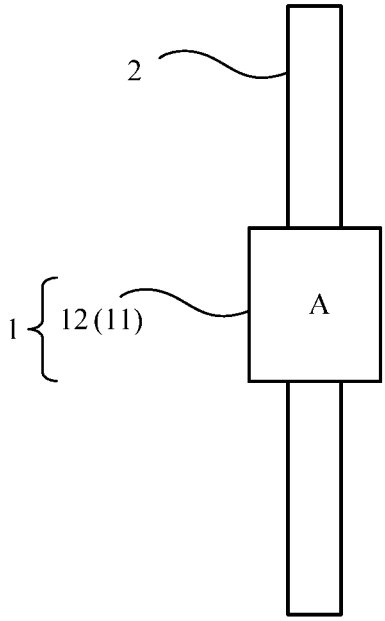
FIG. 1 is a schematic diagram of the folding panel in the folded state of the intelligent watch provided in an embodiment of the present disclosure.

REFERENCE NUMERALS folding panel, 2—watchband, 11, 12, 13, 14—display screen, 31—ball, 32—ball mounting hole, 33—second buckle, 34—second clamping groove, 41—first buckle, 42—first clamping groove, 50—sensor, 60—controller

DETAILED DESCRIPTION

In order to facilitate understanding, the intelligent watch provided in embodiments of the present disclosure will be described in detail hereafter in combination with the accompanying figures.

Embodiments of the present disclosure provide a wearable apparatus, such as an intelligent watch, an intelligent bracelet, an intelligent ring etc. The wearable apparatus includes a mounting component and a folding panel as well as a controller. Wherein, the mounting component is configured to hold a relationship between the relative positions of the wearable apparatus and its user. For example, the mounting component may be the watchband of a watch, the part of an intelligent bracelet surrounding the user's wrist or the part of an intelligent ring surrounding the user's finger.

Embodiments of the present disclosure will only be described in the case of intelligent watches. It can be understood by those skilled in the art that embodiments of the present disclosure may also be applied to other wearable apparatuses.

Figure 2A:
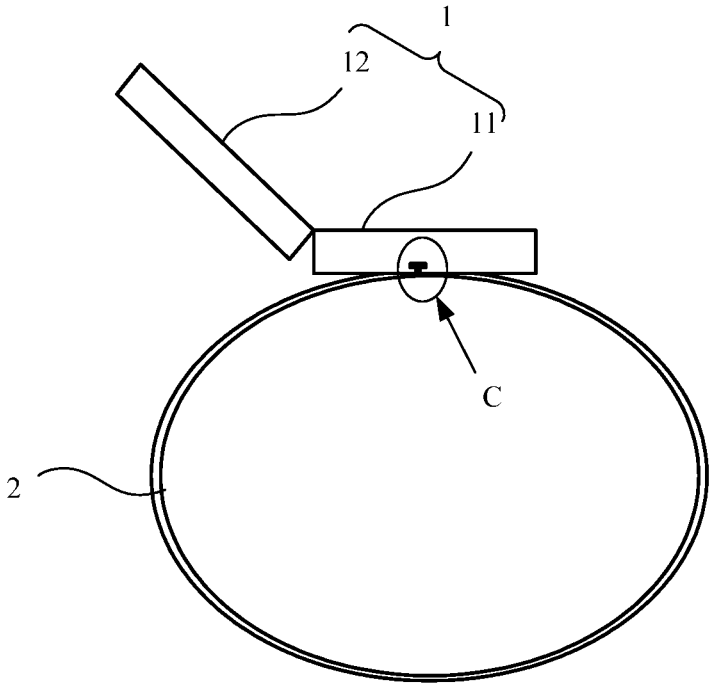
FIG. 2*a* is a schematic diagram illustrating the connection relationship between the folding panel and the watchband in accordance with an embodiment of the present disclosure.
Figure 2B:
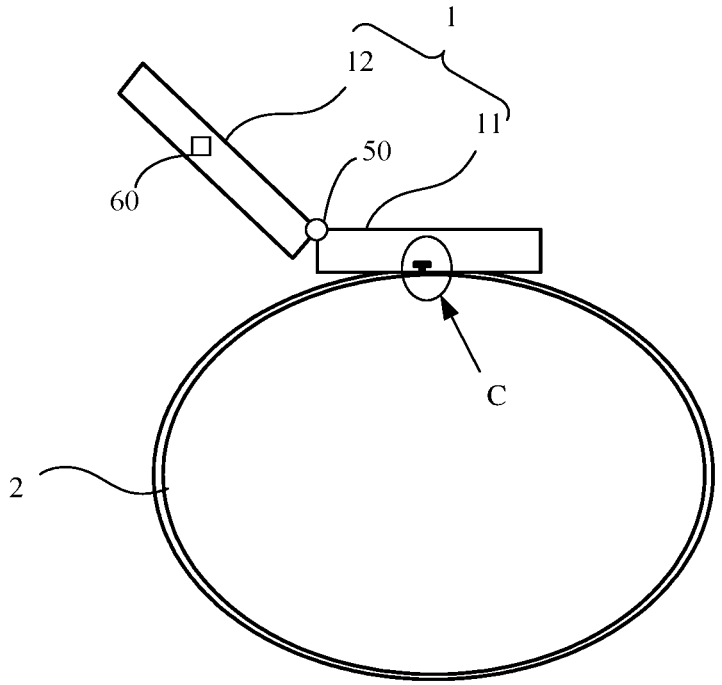
FIG. 2*b* is another schematic diagram illustrating the connection relationship between the folding screen and the watchband in accordance with an embodiment of the present disclosure.

With reference to FIG. 1, an intelligent watch includes a folding panel 1, a watchband 2, a controller and a sensor, wherein the folding panel 1 may be mounted on the watchband 2. The folding panel 1 includes at least two display screens connected together. The at least two display screens may be rotatably interconnected using a pivot shaft, or may be interconnected in any other movable way, for example, through buckle engagement or the like. As illustrated in FIG. 2*b*, a sensor 50 is disposed at the rotatable joint of the two rotatably interconnected display screens. For example, the two display screens 11 and 12 may have their respective sensors 50 disposed at the joint, or either of the two display screens may have a sensor 50 disposed thereon. A controller 60 is in signal connection with individual display screens 11, 12 and individual sensors 50 respectively and controls corresponding display screens to turn on or off based on the state of the folding panel detected by the sensors 50.

In the intelligent watch described above, the state of the folding panel 1 includes a folded state and an unfolded state of the folding panel 1. When used as a watch, the folding panel 1 is in the folded state for convenience of being worn on the user's wrist, and the sensors 50 will detect this and send the detection result to the controller 60, so that the controller 60 can control the uppermost display screen to turn on and display watch functions such as time, date etc. based on the folded state of the folding panel 1. If the user wants to expand the display area to display a web page or a short message or expand the touch area, the folding panel 1 may be in the unfolded state to expand the display area and the touch area. In the case of this state, the sensors 50 detect that the folding panel 1 is in the unfolded state and send the detection result to the controller, which, based on the unfolded state of the folding panel, controls all the display screens to turn on, so that it is convenient for the user to perform touch input, web page browsing and the like. Therefore, in the intelligent watch provided in the present disclosure, the state of the folding panel can be adjusted based on the user's needs to display different information, so that the user's needs can be satisfied.

According to an example of the present disclosure, the watchband 2 may be a two-segment-joining watchband, which has two segments that are joined together through connecting components. The watchband 2 may also be an annular one-piece watchband as illustrated in FIG. 2*a*. The annular one-piece watchband may be a ring of stainless steel, a ring of manganese steel or a ring structure made up of other materials for watchbands. The folding panel 1 and the watchband 2 are interconnected in an undetachable way, for example, through welding, or in a detachable way, for example, through screws or buckles.

Figure 3:
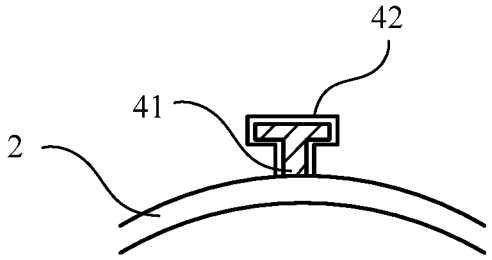
FIG. 3 is an enlarged view of the area C in FIG. 2*a;*

As shown in FIG. 3, according to an example of the present disclosure, a first buckle 41 is disposed on the watchband 2, and a clamping groove 42 is disposed on the back side of the folding panel 1 to mate with the first buckle 41. As used herein, the back side of the folding panel 1 refers to the lower surface of the undermost display screen when the folding panel 1 is in the folded state. For example, the lower surface of the display screen 11 as shown in FIG. 2*a*. As shown in FIG. 3, the first buckle 41 may be, for example, a buckle bar extending along the axial direction of the watchband 2. The cross-section of the buckle bar may be T-shaped, and the corresponding first clamping groove may be a T-shaped groove. That is to say, the first buckle 41 is a T-shaped buckle bar while the first clamping groove is a T-shaped groove; when the folding panel 1 is to be mounted on the watchband 2, the T-shaped groove is engaged with the T buckle bar to mount the folding panel 1 onto the watchband 2. Of course, the first buckle 41 and the first clamping groove 42 may also have other structures that can be joined together through engagement, such as L, E or other structures, which will not be detailed here.

According to an example of the present disclosure, the sensors 50 are disposed at the locations where two adjacent display screens are rotatably connected to each other, and at each rotatable joint where two display screens are rotatably interconnected there is disposed a sensor; the sensors detect the states of individual display screens and in turn the state of the folding panel 1 and send the detection result to the controller 60. The controller 60 controls the corresponding display screen to turn on or turn off its content display based on the state of the folding panel 1 detected by the sensors 50. The sensor 50 may be a pressure sensitive transducer, a Hall sensor or the like. The controller 60 may be an independent chip or has a control ship shared with the intelligent watch. When the controller is an independent chip, the chip may be integrated into one of the display screens to make the intelligent watch have nicer appearance. Of course, a plurality of display screens may have their respective controllers disposed therein to control their display respectively. The controllers in the plurality of display screens may be further classified into main controller and secondary controller as required.

In the intelligent watch described above, the folding panel 1 may be constituted by two or more display screens, and in the following description the connection relationships between individual display screens and the way to unfold the folding panel 1 will be illustrated in the case of two or three display screens.

Figure 4:
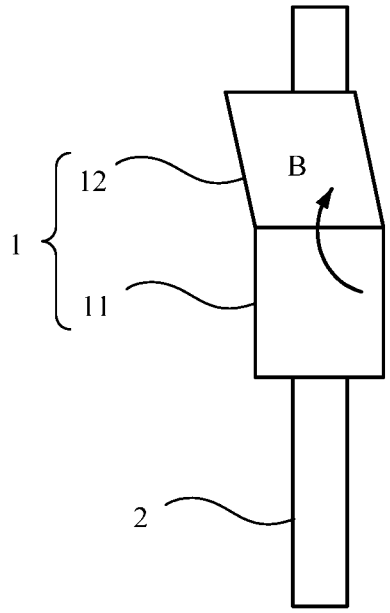
FIG. 4 is a schematic diagram illustrating the unfolding way of the folding panel in specific embodiment 1 of the present disclosure.

In embodiment 1, as can be seen from FIG. 4, the folding panel 1 includes two display screens: a display screen 11 and a display screen 12. The display screen 11 and the display screen 12 are usually connected together by means of a pivot shaft. For example, the display screens 11 and 12 are both rectangular display screens. A pivot shaft is mounted at a side edge of the display screen 11 and has its length direction parallel with the length direction of this side edge. A shaft hole is disposed at a side edge of the display screen 12 for the pivot shaft to pass through. The display screen 11 and the display screen 12 are interconnected to allow rotation by means of the coordination between the pivot shaft and the shaft hole. The sensors 50 may be disposed on the pivot shaft or the shaft hole to detect the states of the display screens 11 and 12 and thus the state of the folding panel 1.

When used as a watch, as shown in FIG. 1, the display screen 12 is covered on the display screen 11, so that the folding panel 1 is in the folded state, and the controller controls the display screen 11 to turn off and the display screen 12 to display based on the state of the folding panel 1 (in which the folding panel is folded) detected by the sensors. When the user needs to enlarge the display area to display a web page or a short message or enlarge the touch area, the display screen 12 is rotated in the direction indicated by the arrow shown in FIG. 4 until it arrives at the position shown in FIG. 5. At this point, the upper surface of the display screen 12 is flush with that of the display screen 11, so that the folding panel 1 is switched to the unfolded state and then the controller controls both of the display screens 11 and 12 to turn on based on the state of folding panel 1 (in which the folding panel 1 is unfolded) detected by the sensors. Therefore, as compared with the folded state of the folding panel 1 in which only one display screen is used to display, when the folding panel 1 in the present embodiment is in the unfolded state, two display screens are used to display and to input information through touch, so that the display area and the touch area of the intelligent watch are obviously enlarged, i.e. the area of the display area or the touch area is increased twice, making it convenient for the user to browse web pages, answer emails or the like, allowing the intelligent watch to have functions similar to those of intelligent cellphones and tablet computers and facilitating the use by the user.

Figure 5:
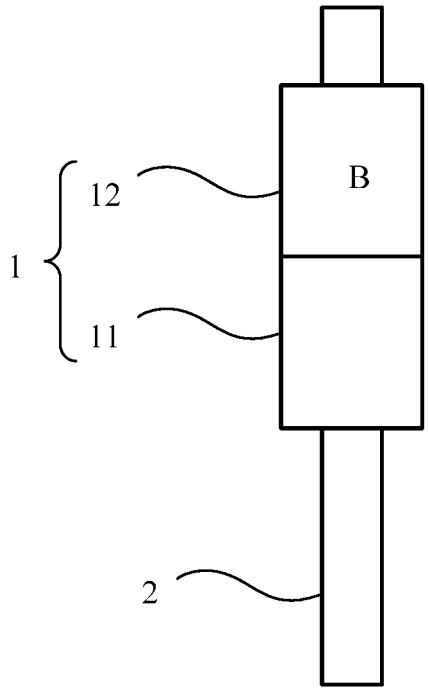
FIG. 5 is a schematic diagram of the folding panel in FIG. 4 when it is in the unfolded state.

In embodiment 1 described above, when the folding panel 1 is in the folded state, the uppermost display screen 12 is usually called top screen or top display screen, which may be a single-sided display screen or a double-sided display screen. In the present embodiment, the top screen (display screen 12) is a double-sided display screen, including side A and side B as shown in FIG. 1 and FIG. 5. When the folding panel 1 is in the folded state, as shown in FIG. 1, side A of the display screen 12 displays watch functions such as time, date, etc. When the folding panel 1 is in the unfolded state, as shown in FIG. 5, side A of the display screen 12 faces away from the user and as a result the user cannot to see what is displayed on side A of the display screen 12 if he does not turn the intelligent watch over. As a result, in order to reduce power consumption, when the folding panel 1 is in the unfolded state, side A of the display screen 12 may be in Off or sleeping state under control of the controller, while side B of the display screen 12 is in On state and used in coordination with the display screen 11.

Figure 6:
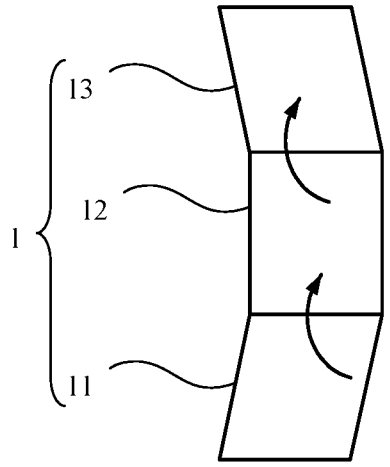
FIG. 6 is a schematic diagram illustrating the unfolding way of the folding screen in specific embodiment 2 of the present disclosure.
Figure 7:
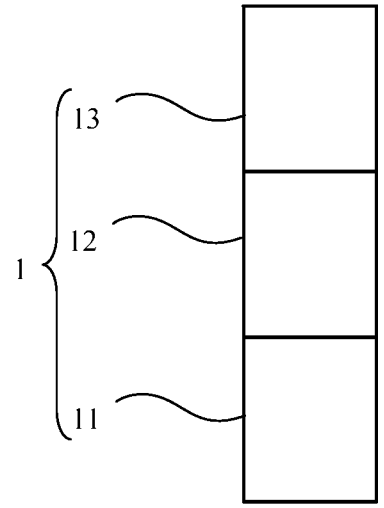
FIG. 7 is a schematic diagram of the folding panel in FIG. 6 when it is in the unfolded state.

In embodiment 2, as seen from FIG. 6, the folding panel 1 includes three display screens, i.e. a display screen 11, a display screen 12 and a display screen 13. The display screen 11 and the display screen 12 may be rotatably interconnected by means of a pivot shaft, and so do the display screen 12 and the display screen 13. When used as a watch, the display screen 13 and the display screen 12 are stacked on top of each other, i.e. the display screen 13 is covered on the display screen 12, and the display screen 12 and the display screen 11 are also stacked on top of each other, so that the folding panel 1 is in the folded state, and the uppermost display screen is used to display watch functions, such as time, date, etc. When the user needs to enlarge the display area to display web pages or short messages, the display screen 12 and the display screen 13 are rotated in the directions indicated by the arrows shown in FIG. 6 and form a display area of the shape shown in FIG. 7 after the spreading. When the folding panel 1 is switched to the unfolded state, the controller controls all of the display screens 11, 12 and 13 to turn on based on the state of the folding panel 1 (in which the folding panel is unfolded). Therefore, as compared with the folded state in which only one display screen is used to display, when the folding panel is in the unfolded state, three display screens are used to display and to input information through touch, which makes the display area and the touch area of the intelligent watch obviously enlarged, i.e. the area of the display area or the touch area is increased three times, making it convenient for the user to browse web pages, answer emails or the like, endowing the intelligent watch with functions similar to those of intelligent cellphones and tablet computers to facilitate the user's operation.

In the two embodiments described above, the rotation angle of one display screen with respect to another display screen is less than or equal to 180°. For example, as shown in FIG. 2, the rotation angle of the display screen 12 with respect to the display screen 11 is less than or equal to 180 degree. If the rotation angle is too big, it will be inconvenient for the user to view the contents on the display screen 12 and the display screen 11 simultaneously.

Figure 8:
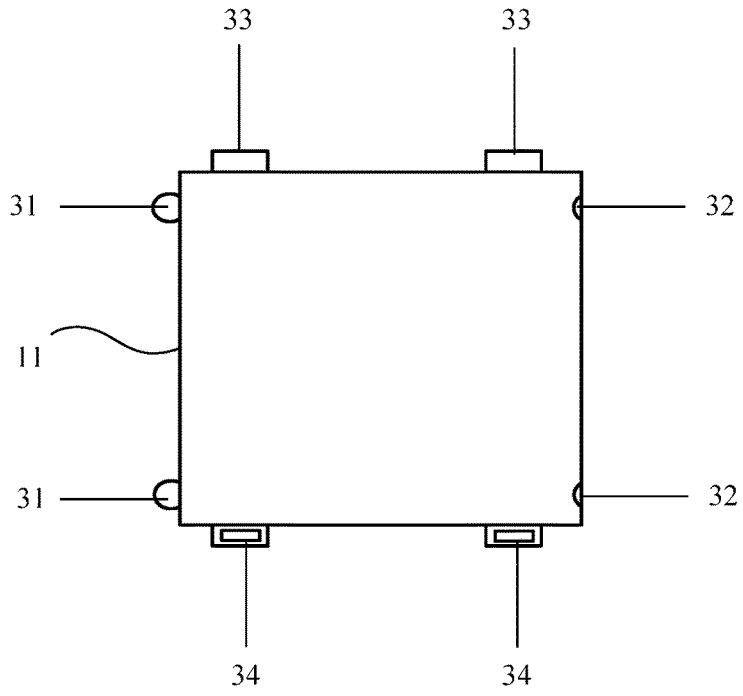
FIG. 8 is a structure diagram of the display screen in FIGS. 4 and 6.

It should be added that two display screens interconnected rotatably are not limited to be interconnected by means of a pivot shaft, but may be interconnected by means of balls. Specifically, as shown in FIG. 8, the display screen 11 has a rectangular shape; one of a pair of opposite side edges of the display screen 11 (the left and right edges in FIG. 8) has balls 31 disposed thereon while the other of the pair of side edges has ball mounting holes 32 disposed therein to mate with the balls 31. The number of the balls 31 may be set as required. In the structure shown in FIG. 8, the left edge of the display screen 11 is configured with two balls 31 that may rotate with respect to but without detaching from the display screen 11, while the right edge of the display screen 11 is configured with two ball mounting holes 32; another display screen that is to be rotatably connected with this display screen is also configured with balls at one side edge that are disposed in the same way as the balls 31 disposed at the left edge of the display screen 11. During assembling, the balls 31 of the display screen 11 are embedded in the ball mounting holes 32 of another display screen, and can rotate therein without escaping therefrom.

In embodiment 1 described above, the uppermost display screen 12 is a double-sided display screen. If the display screen 12 is a single-sided display screen, for example, it is a display screen that can only display contents on side A, when the folding panel is in the unfolded state, side B of the display screen 12 cannot display contents, and as a result the display area and the touch area of the intelligent watch cannot be enlarged now. In addition, there is also provided a folding panel that may use single-sided display screens and allow enlargement of the display area and touch area of an intelligent watch, as can be seen from embodiment 3.

Figure 9:
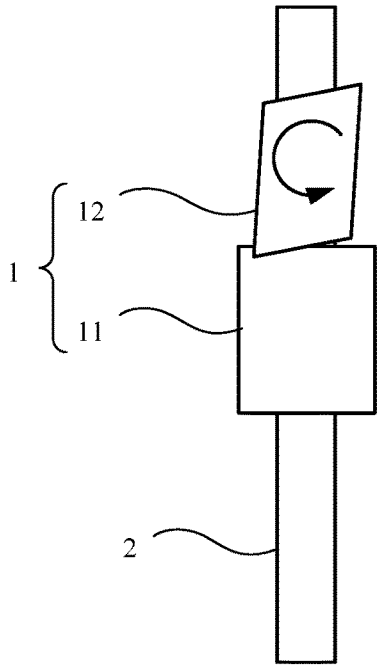
FIG. 9 is a schematic diagram illustrating the unfolding way of the folding screen in specific embodiment 3 of the present disclosure.
Figure 10:
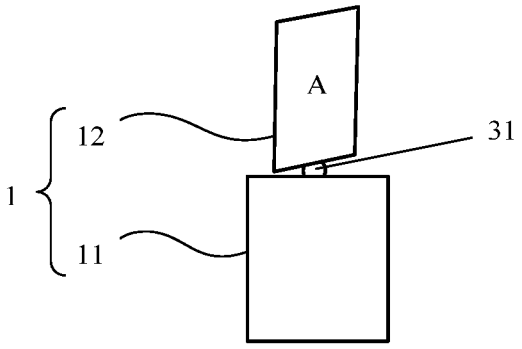
FIG. 10 is a schematic diagram illustrating the way of interconnection between two display screens in FIG. 9.

In embodiment 3, as seen from FIGS. 9 and 10, the folding panel 1 includes two display screens, i.e. the display screen 11 and the display screen 12, which are rotatably interconnected by means of one ball 31. When used as a watch, the display screen 12 is covered on the display screen 11 with side A of the display screen 12 being left uncovered to display watch functions such as time, date etc. When the user needs to enlarge the display area to display webpages or messages for example, the display screen 12 may be rotated 180° with respect to the display screen 11, at which point side A of the display screen 12 faces downwards, making the contents displayed thereon invisible for the user; then the display screen 12 is again rotated 180° around the ball 31 to make side A of the display screen 12 face upwards, so that the user can view contents on the display screen 11 and on side A of the display screen 12 simultaneously.

Figure 11:
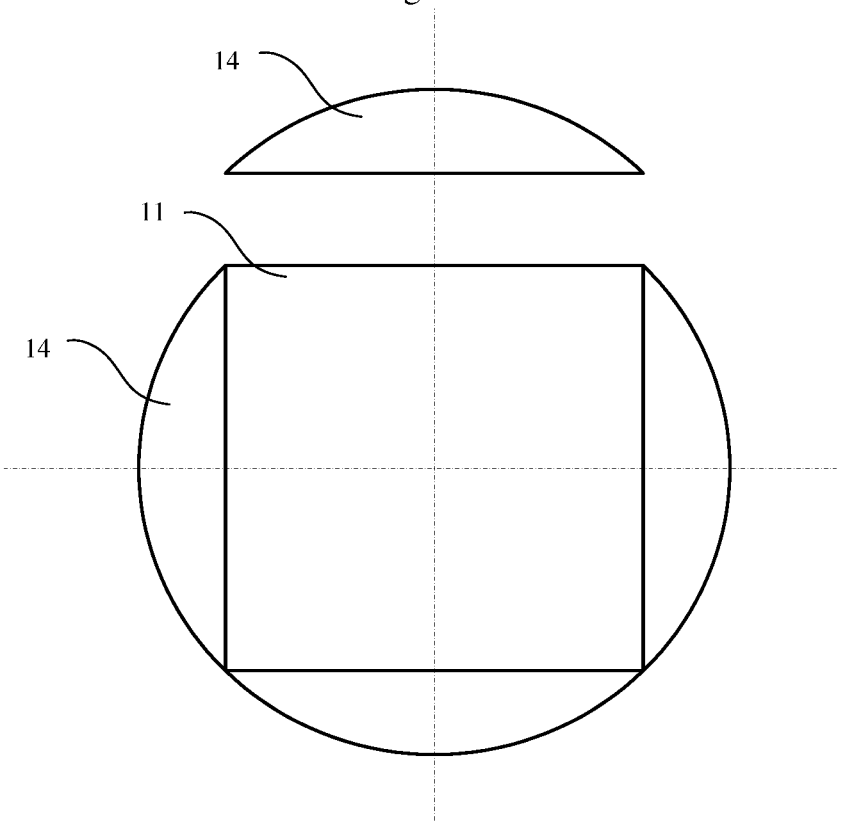
FIG. 11 is a schematic diagram of a folding screen provided in an embodiment of the present disclosure when it is in the unfolded state.

In the various embodiments described above, the display screen may have a rectangular, triangle, trapezoid, circle, semi-circle or other irregular personalized shape. The folding panel 1 in the unfolded state has a rectangular, triangle, trapezoid, circle, semi-circle or other irregular personalized shape. For example, as shown in FIGS. 1 and 5, the display screen 11 and the display screen 12 are both rectangular shaped, and thus the folding panel 1 in the unfolded state has a rectangular shape formed by the two rectangular shaped display screens. For another example, the folding panel 1 includes five display screens, wherein the display screen 11 is a rectangular display screen while the other four display screens 14 are all display screens with circular arc edges. The four display screens 14 are respectively connected to the four edges of the display screen 11 in a rotatable way. When the folding panel 1 is in the folded state, the four display screens 14 are respectively covered on the display screen 11. At this point, one or more of the contents of time, date, indication of whether or not having received short messages or emails, indication of whether or not there is an incoming call, music and the like may be displayed on the upper surfaces of the four display screens 14. When the folding panel 1 is in the unfolded state, a circular display area is formed by the four display screens 14 and the display screen 11, as shown in FIG. 11.

Furthermore, when there are a plurality of display screens, for example, the folding panel 1 includes nine display screens, in order to ensure the stability of the folding panel 1 in the unfolded state, the two adjacent display screens without rotatable connection therebetween are joined by means of engagement between buckles and clamping grooves. For example, see FIG. 8 again, the display screen 11 has a rectangular shape; one of a pair of opposite side edges of the display screen 11 (the left and right edges in FIG. 8) has balls 31 disposed thereon while the other of the pair of side edges has ball mounting holes 32 disposed therein to mate with the balls 31; one of the other pair of side edges of the display screen 11 (the upper and the lower edges in FIG. 8) has second buckles 33 disposed thereon while the other of the pair of side edges has second clamping grooves 34 disposed therein to mate with the second buckles 33. When the folding panel 1 is in the unfolded state, two adjacent display screens without rotatable connection therebetween are interconnected by means of the engagement between the second buckles 33 and the second clamping grooves 34, so that the folding panel in the unfolded state may have its stability improved.

What are described above are only embodiments of this disclosure, which should not limit the scope of this disclosure. The modifications and variations can be get easily by any skilled in the art in the technical scope of this disclosure should be all covered in the scope of this disclosure. Thus, the scope of this disclosure should be according to the scope of the claims.

The present application claims priority of China Patent application No. 201510670909.2 filed on Oct. 15, 2015, the content of which is incorporated in its entirety as part of the present application by reference herein.

What is claimed is:

1. A wearable apparatus, comprising:

a mounting component configured to hold a relationship between relative positions of the wearable apparatus and its user;

a plurality of sensors;

a folding panel mounted on the mounting component, the folding panel including at least two display screens interconnected at a rotatable joint where said plurality of sensors are disposed; and a controller, said controller being signal connected with individual display screens and the plurality of sensors respectively, the controller being configured to control corresponding display screens to turn on or turn off based on a state of the folding panel detected by the plurality of sensors;

wherein the at least two display screens comprise five display screens; wherein one of the five display screens is a rectangular display screen having four edges, while a remaining four display screens comprise circular arc edges; wherein the remaining four display screens are respectively connected to said four edges of the rectangular display screen in a rotatable manner.

2. The wearable apparatus of claim 1, wherein the folding panel comprises a wearable component which is an intelligent watch and the mounting component is a watchband of the intelligent watch.

3. The wearable apparatus of claim 2, wherein the watchband is an annular one-piece watchband.

4. The wearable apparatus of claim 2, wherein a first buckle is disposed on the watchband and a first clamping groove is disposed on a back side of the folding panel to engage with the first buckle.

5. The wearable apparatus of claim 4, wherein the first buckle is a buckle bar extending along an axial direction of the watchband.

6. The wearable apparatus of claim 5, wherein a cross-section of the buckle bar is T-shaped, and the first clamping groove is correspondingly a T groove.

7. The wearable apparatus of claim 1, wherein one of the display screens of the folding panel may rotate with respect to another one an angle less than or equal to 180°.

8. The wearable apparatus of claim 1, wherein at least two display screens of said five display screens have their respective sensors disposed on the rotatable joint therebetween.

9. The wearable apparatus of claim 1, wherein the at least two display screens of said five display screens include a first display screen, a second display screen and a third display screen; the first display screen and the second display screen are rotatably interconnected and the second display screen and the third display screen are rotatably interconnected as well.

10. The wearable apparatus of claim 9, wherein, when the folding panel is in a folded state, the third display screen and the second display screen are stacked on top of each other, the third display screen is covered on the second display screen, and the second display screen and the first display screen are stacked on top of each other as well.

11. The wearable apparatus of claim 1, wherein the four display screens are covered on the rectangular display screen when the folding panel is in a folded state.

12. The wearable apparatus of claim 1, wherein the four display screens and the first display screen form a circular display area when the folding panel is in an unfolded state.

13. The wearable apparatus of claim 1, wherein, with the rectangular display screen, one of a pair of opposite side edges of a display screen has balls disposed thereon while the other of the pair of side edges has ball mounting holes disposed therein to mate with the balls, or one of a pair of opposite side edges of the rectangular display screen has a pivot shaft disposed thereon while the other of the pair of side edge has a shaft hole disposed therein to mate with the pivot shaft.

14. The wearable apparatus of claim 13, wherein another pair of opposite side edges of the rectangular display screen has a second buckle disposed thereon while the other of the pair of side edges has a clamping groove disposed therein to mate with the second buckle.

15. The wearable apparatus of claim 1, wherein, when the folding panel is in a folded state, the uppermost display screen is a top screen which is a single-sided display screen or a double-sided display screen.

16. The wearable apparatus of claim 1, wherein the folding panel in an unfolded state has a substantially circular shape.

17. The wearable apparatus of claim 1, wherein the controller is a chip, which is integrated in at least one of the display screens.

18. A wearable apparatus, comprising:

a mounting component configured to hold a relationship between relative positions of the wearable apparatus and its user;

a plurality of sensors;

a folding panel mounted on the mounting component, the folding panel including at least two display screens interconnected at a rotatable joint where said plurality of sensors are disposed; and a controller, said controller being signal connected with individual display screens and the plurality of sensors respectively, the controller being configured to control corresponding display screens to turn on or turn off based on a state of the folding panel detected by the plurality of sensors;

wherein the display screens have a shape of rectangular, and with the rectangular display screen, one of a pair of opposite side edges of a display screen has balls disposed thereon while the other of the pair of side edges has ball mounting holes disposed therein to mate with the balls;

wherein the at least two display screens comprise five display screens; wherein one of the five display screens is a rectangular display screen having four edges, while a remaining four display screens comprise circular arc edges; wherein the remaining four display screens are respectively connected to said four edges of the rectangular display screen in a rotatable manner.

* * * * *